US007640686B2

(12) United States Patent
Wai

(10) Patent No.: US 7,640,686 B2
(45) Date of Patent: Jan. 5, 2010

(54) CREASER ACCESSORY DEVICE FOR HAND HELD STEAMER

(75) Inventor: Victor Wai, Tsim Sha Tsui (HK)

(73) Assignee: Vertical Branding, Inc., Encino, CA (US)

( * ) Notice: Subject to any disclaimer, the term of this patent is extended or adjusted under 35 U.S.C. 154(b) by 0 days.

(21) Appl. No.: 12/032,585

(22) Filed: Feb. 15, 2008

(65) Prior Publication Data

US 2009/0205229 A1 Aug. 20, 2009

(51) Int. Cl.
*D06F 75/38* (2006.01)
*D06F 75/30* (2006.01)

(52) U.S. Cl. ..... 38/97; 38/93; 38/81

(58) Field of Classification Search ..... 38/69, 38/70, 81, 88, 93, 94, 97, 71; 219/245, 249
See application file for complete search history.

(56) References Cited

U.S. PATENT DOCUMENTS 1,095,925 A * 5/1914 Pogue ..... 38/71
3,074,192 A * 1/1963 Smith ..... 38/93
3,577,859 A * 5/1971 Davidson ..... 38/71
4,032,747 A * 6/1977 Kunz ..... 219/222
4,219,724 A 8/1980 Allvin
4,636,613 A * 1/1987 de la Morandiere et al. . 219/249
4,642,921 A * 2/1987 Primati ..... 38/36
4,817,309 A 4/1989 Frank et al.
4,953,300 A * 9/1990 Davidson et al. ..... 38/36
6,513,269 B2 * 2/2003 Kobayashi et al. ..... 38/93
7,121,024 B1 10/2006 Clevenberg
7,188,442 B2 * 3/2007 Fernandez ..... 38/81

* cited by examiner

*Primary Examiner*—Ismael Izaguirre
(74) *Attorney, Agent, or Firm*—Fulwider Patton LLP

(57) ABSTRACT

The creaser accessory device includes first and second plates pivotally connected to a lever arm that can be operated by a user to pivot the plates away from each other to receive a portion of a garment, and toward each other to press the portion of the garment such as to form a crease in the garment. The typically have apertures therethrough to allow steam from a hand held steam generating device removably coupled to the creaser accessory device to pass through the apertures to heat the portion of the garment when received in the creaser accessory device.

4 Claims, 2 Drawing Sheets

CREASER ACCESSORY DEVICE FOR HAND HELD STEAMER

BACKGROUND OF THE INVENTION

The present invention relates generally to hand held steam generating devices, and more particularly relates to a creaser accessory device configured to be removably coupled to a hand held steam generating device for steam creasing of a portion of a garment.

One conventional manually operable device for pressing fabric includes triangular-shaped jaws with flat surface portions that face each other. The jaws have handles pivotally connected together so that the two flat surface portions can be moved to be separated for inserting fabric between them, or in parallel pressure engagement for pressing the fabric. One of the jaws includes an electric heating element with an adjustable thermostatic control.

Another hand held steam presser includes a support with steam holes, and a pressure plate with steam exit holes releasably secured to the support plate. The pressure plate is movable towards the support plate counter to the pressure of a spring.

Another type of steam creaser includes first and second members pivotally connected together, with at least one of the first and the second member providing heat. Fabric can be positioned between the first and second members for heating of the fabric.

It would be desirable to provide a creaser accessory device for a hand held steam generating device that can be removably coupled to a variety of steaming brushes or to the creaser accessory device for steam creasing of a portion of a garment inserted in the creaser accessory device. The present invention addresses this need.

SUMMARY OF THE INVENTION

Briefly, and in general terms, the present invention provides for a creaser accessory device with first and second plates each pivotally connected to a lever arm that can be operated by a user to pivot the first and second plates away from each other to receive a portion of a garment therebetween, to pivot the first and second plates together to press the portion of the garment to form a crease in the garment, and to pivot the first and second plates apart to release the portion of the garment once the portion of the garment has been pressed.

Accordingly, the present invention provides for a creaser accessory device for forming a crease in a portion of a garment. The creaser accessory device includes first and second plates having a proximal end and a distal end, with each of the first and second plates having inner generally planar mating surfaces adjacent to each other. A lever arm is pivotally connected to each of the first and second plates and pivotally connects the first and second plates together. The first and second plates are configured to be moved by the lever arm between an open configuration and a closed configuration, the distal ends of the first and second plates being spaced apart in the open configuration a sufficient distance to allow a portion of the garment to be received therebetween, and the distal ends of the first and second plates in the closed configuration being moved toward each other such that the inner generally planar mating surfaces of the first and second plates are operative to press the portion of the garment received therebetween to form a crease in the portion of the garment.

In a preferred aspect, the lever arm is configured to be operated by a user to pivot the distal ends of the first and second plates away from each other to receive the portion of the garment therebetween. The lever arm is also preferably configured to be operated by a user to pivot the distal ends of the first and second plates together to press the portion of the garment to form a crease in the portion of the garment received therebetween, and to be operated by the user to pivot the distal ends of the first and second plates apart to release the portion of the garment once the portion of the garment has been pressed.

In a presently preferred aspect, the first and second plates each have a plurality of apertures therethrough to allow steam from a hand held steam generating device coupled to the creaser accessory device to pass through the apertures to heat the portion of the garment received between the first and second plates. The creaser accessory device is typically configured to be removably coupled to such a hand held steam generating device for generating steam to pass through the apertures of the first and second plates for delivering steam heat to the portion of the garment received between the first and second plates.

In another preferred aspect, the creaser accessory device includes a tab member extending from the distal end of one of the first and second plates, and a slotted member at the proximal end of the one of the first and second plates, for removably connecting the creaser accessory device to a corresponding coupling mechanism of the hand held steam generating device.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
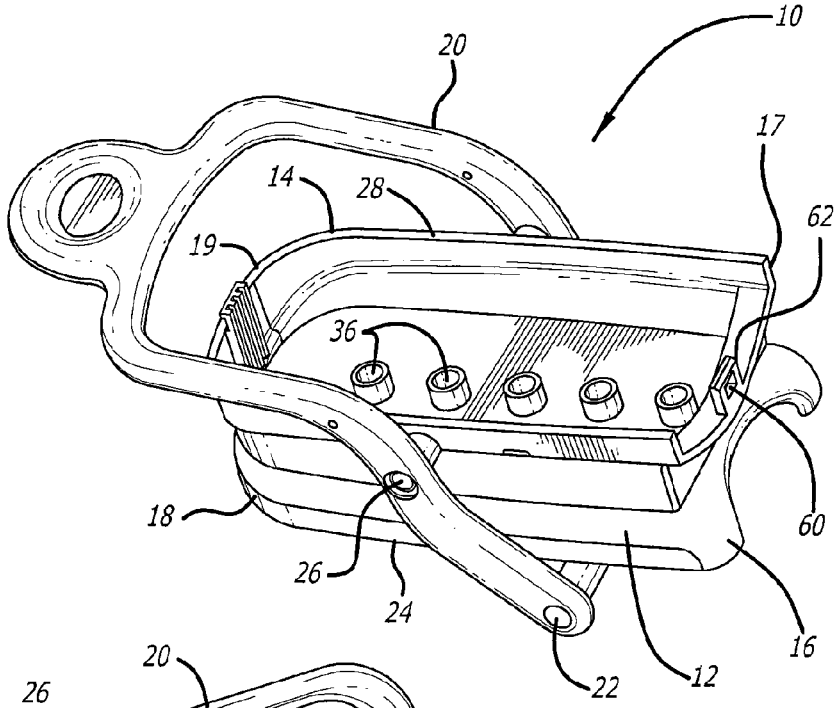
FIG. 1 is a bottom perspective view of the creaser accessory device of the present invention.

Referring to the drawings, which are provided by way of example, and not by way of limitation, the present invention provides for a creaser accessory device 10, including first and second plates 12, 14, each having a proximal end 16, 17, and a distal end 18, 19. The first and second plates are pivotally connected together by a lever arm 20 pivotally connected to the first plate at a location 22 proximal to a longitudinal midpoint 24 of the first plate, and pivotally connect to the second plate at a location 26 substantially at about the longitudinal midpoint 28 of the second plate.

Figure 4:
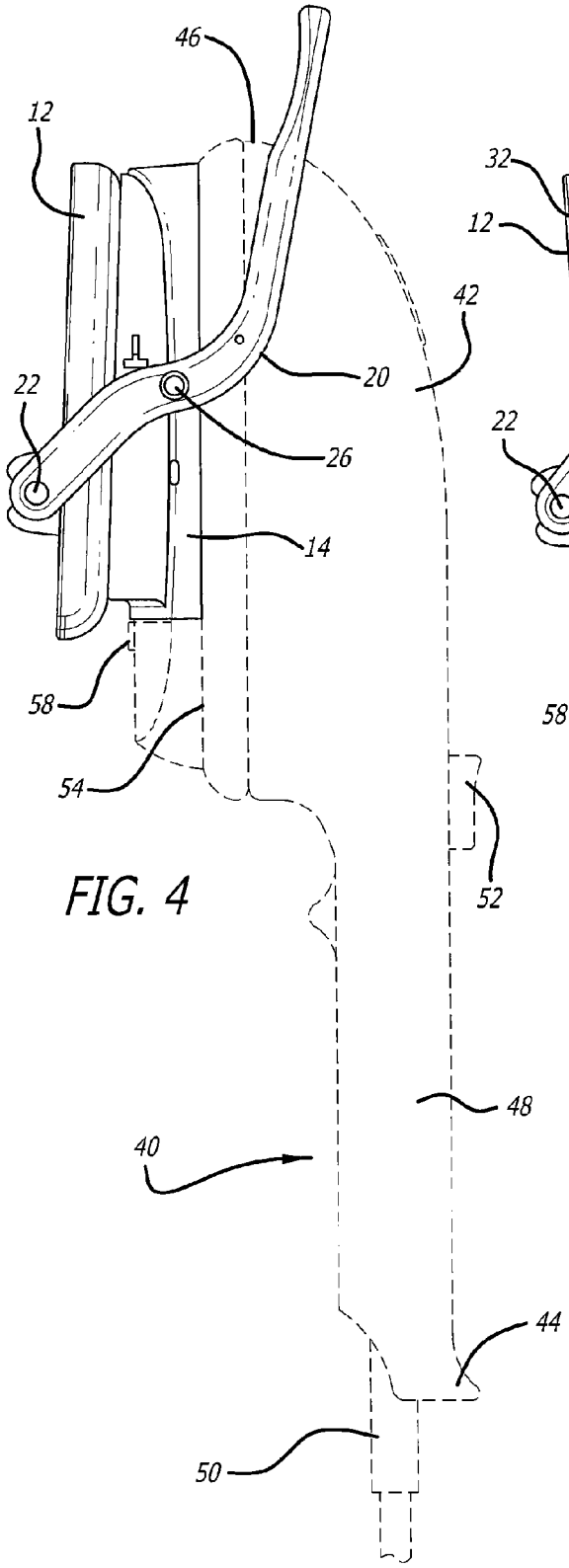
FIG. 4 is a side elevational view of the creaser accessory device similar to FIG. 3, removably coupled to a hand held steam generating device shown in phantom, illustrating the creaser accessory device in a closed configuration.
Figure 5:
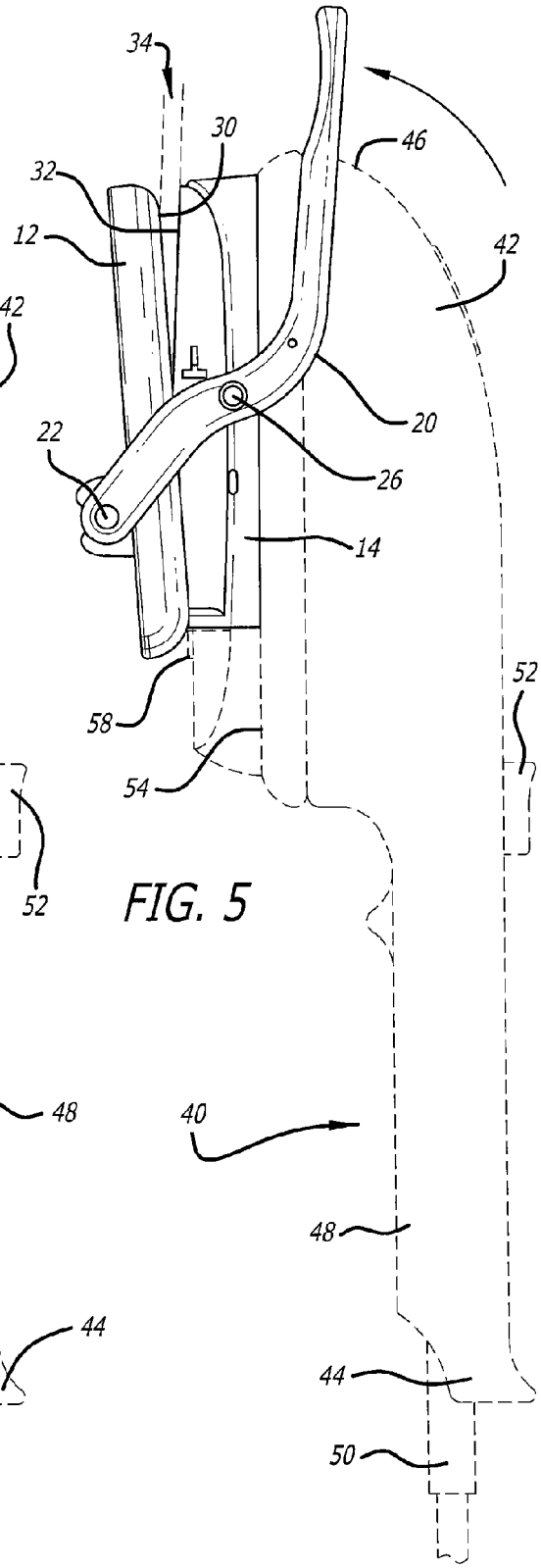
FIG. 5 is a side elevational view of the creaser accessory device similar to FIG. 4, removably coupled to a hand held steam generating device shown in phantom, illustrating the creaser accessory device in an open configuration.

Referring to FIG. 5, each of the first and second plates have inner generally planar facing or mating surfaces 30, 32 adjacent to each other. The first and second plates are configured to be moved between a closed configuration shown in FIG. 4, and an open configuration shown in FIG. 5. The first and second plates in the open configuration are spaced apart at the distal end a sufficient distance 34 to allow a portion of a garment, such as a portion of a trouser leg (not shown), for example, to be received between the first and second plates. The distal ends of the first and second plates in the closed configuration are moved towards each other from the open configuration such that the inner planar facing surfaces of the first and second plates press the portion of the garment received between the first and second plates to form a crease in the portion of the garment.

Figure 2:
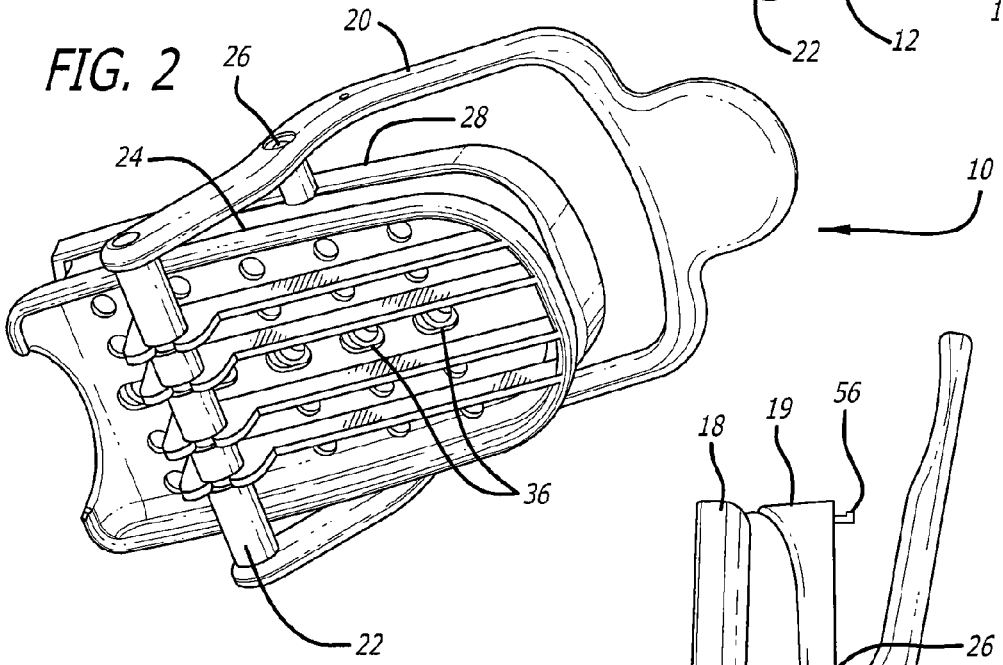
FIG. 2 is a top perspective view of the creaser accessory device of FIG. 1.

Referring to FIGS. 1 and 2, the first and second plates have a plurality of apertures 36 therethrough to allow steam to pass through the apertures to heat the portion of the garment received between the first and second plates, and the creaser accessory device is configured to clip onto a hand held steamer 40, illustrated in phantom in FIGS. 4 and 5, for generating steam to pass through the apertures of the first and second plates to deliver steam heat to the portion of the garment received between the first and second plates. The lever arm can be operated by a user to pivot the distal ends of the first and second plates away from each other to receive the portion of the garment therebetween. The lever arm can then be operated by a user to pivot the distal ends of the first and second plates together to press the portion of the garment to form a crease in the portion of the garment, and the lever arm can then be operated by the user to pivot the distal ends of the first and second plates apart to release the portion of the garment once the portion of the garment has been pressed.

The hand held steamer typically includes a plastic housing, with a main body 42 having a proximal end 44 and a distal end 46, and a handle 48 attached to the proximal end of the main body, and an electrical power cord 50 connected to the handle. The housing includes an electrical steam generating heater (not shown) configured to receive electrical power from the electrical cord. The heater typically includes a refillable reservoir (not shown), a manually operated pump operated by pushing a button 52 for drawing water from the reservoir and injecting the water into the heater to generate steam. Steam emitting ports (not shown) along an exterior steam emitting face 54 of the main body, extending between the proximal and distal ends of the main body. The exterior steam emitting face of the main body includes a coupling apparatus (not shown) for removably receiving an accessory, such as a brush, and in particular for removably receiving the creaser accessory device.

Figure 3:
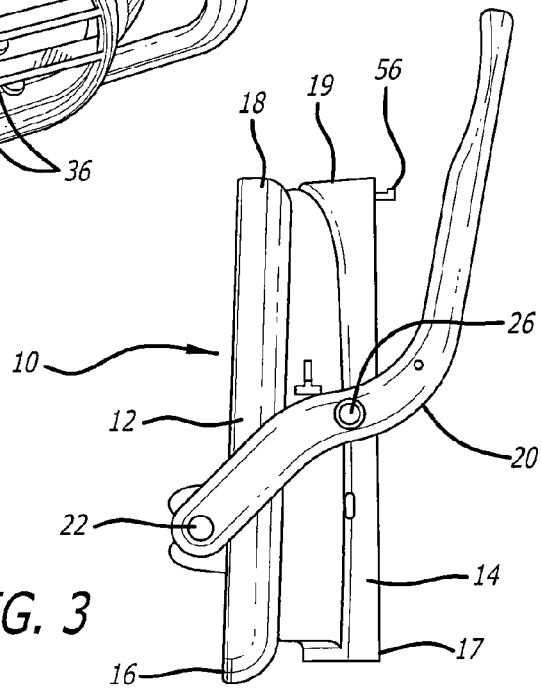
FIG. 3 is a side elevational view of the creaser accessory device of FIG. 1.

The coupling apparatus on the main body of the steamer typically includes a slot (not shown) at the distal end of the exterior steam emitting face of the main body for receiving a corresponding tab member 56 (best seen in FIG. 3) extending from the distal end of the creaser accessory device, and a sliding tab 58 slidable between a distally directed position and a proximally directed position, the sliding tab being configured to engage a corresponding slot 60 of a slotted member 62 (best seen in FIG. 1) of the accessory in the distally directed position, the sliding tab being configured to disengage the accessory in the proximally directed position, and the sliding tab being biased toward the distally directed position engaging the corresponding slot of the creaser accessory.

It will be apparent from the foregoing that while particular forms of the invention have been illustrated and described, various modifications can be made without departing from the spirit and scope of the invention. Accordingly, it is not intended that the invention be limited, except as by the appended claims.

The invention claimed is:

1. A creaser accessory device for forming a crease in a portion of a garment, the creaser accessory device comprising:

first and second plates having a proximal end and a distal end, each of the first and second plates having inner generally planar mating surfaces adjacent to each other, a tab member extending from the distal end of one of said first and second plates, and a slotted member at the proximal end of said one of said first and second plates, whereby said first and second plates of the creaser accessory device are configured to be removably coupled to a hand-held steamer; and a lever arm pivotally connected to each of the first and second plates and pivotally connecting the first and second plates together, wherein the first and second plates are configured to be moved by said lever arm between an open configuration and a closed configuration, the distal ends of said first and second plates being spaced apart in the open configuration a sufficient distance to allow a portion of the garment to be received therebetween, and the distal ends of the first and second plates in the closed configuration being moved toward each other such that the inner generally planar mating surfaces of the first and second plates are operative to press the portion of the garment received therebetween to form a crease in the portion of the garment.

2. The creaser accessory device of claim 1, wherein the first and second plates have a plurality of apertures therethrough to allow steam to pass through the apertures to heat the portion of the garment received between the first and second plates, whereby steam from the hand-held steamer can pass through the apertures of the first and second plates for delivering steam heat to the portion of the garment received between the first and second plates.

3. The creaser accessory device of claim 1, wherein the lever arm is configured to be operated by a user to pivot the distal ends of the first and second plates away from each other to receive the portion of the garment therebetween.

4. The creaser accessory device of claim 1, wherein the lever arm is configured to be operated by a user to pivot the distal ends of the first and second plates together to press the portion of the garment to form a crease in the portion of the garment received therebetween, and the lever arm is configured to be operated by the user to pivot the distal ends of the first and second plates apart to release the portion of the garment once the portion of the garment has been pressed.

* * * * *